United States Patent [19]

Leonard et al.

[11] Patent Number: 4,634,351

[45] Date of Patent: Jan. 6, 1987

[54] DIAPHRAGM PUMP

[75] Inventors: Gary L. Leonard, Clifton Park; Roger N. Johnson, Hagaman, both of N.Y.

[73] Assignee: General Electric Company, Schenectady, N.Y.

[21] Appl. No.: 793,366

[22] Filed: Oct. 31, 1985

[51] Int. Cl.[4] ..... F04B 43/06

[52] U.S. Cl. ..... 417/395; 92/103 M

[58] Field of Search ..... 417/395, 900; 92/103 M

[56] References Cited

U.S. PATENT DOCUMENTS

| | | | |
|---|---|---|---|
| 2,843,050 | 7/1958 | Harper | 417/395 X |
| 3,050,002 | 8/1962 | Harris | 417/900 X |
| 3,277,829 | 10/1966 | Burgert | 417/395 X |
| 4,087,209 | 5/1978 | Mahig et al. | 417/268 |
| 4,138,931 | 2/1979 | Hermann et al. | 417/399 |
| 4,265,600 | 5/1981 | Mandroian | 417/395 |
| 4,469,596 | 9/1984 | Kantor | 210/137 |
| 4,569,641 | 2/1986 | Falk et al. | 417/417 |

FOREIGN PATENT DOCUMENTS

| | | | |
|---|---|---|---|
| 1186562 | 5/1985 | Canada . | |
| 787226 | 9/1935 | France | 417/395 |
| 2510672 | 2/1983 | France | 417/395 |

*Primary Examiner*—Leonard E. Smith

*Attorney, Agent, or Firm*—Paul R. Webb, II; James C. Davis, Jr.

[57] ABSTRACT

A diaphragm pump includes a flexible diaphragm mounted in a pump housing and sealingly separating internal pumping and driving chambers. An inlet aperture is situated to conduct pressurized material into the pumping chamber in a direction tangential to a surface of an end-portion of the pumping chamber, this end-portion having a circular cross-sectional shape and adjoining the diaphragm. The driving chamber comprises a plurality of interconnected grooves disposed in a pump housing surface normally contacting the diaphragm when the diaphragm is in an unflexed position. A plurality of fluid apertures are disposed to conduct a hydraulic pumping fluid into the driving chamber at a plurality of discrete locations.

13 Claims, 6 Drawing Figures

DIAPHRAGM PUMP

The present invention relates in general to pumps and in particular to a diaphragm pump for pumping slurry materials at a high pressure and rate.

BACKGROUND OF THE INVENTION

In applications requiring the pumping of slurry materials, a generally encountered problem is that of preventing particulate matter in the slurry from fouling the operation of a pump. For example, in systems requiring the use of a coal-water slurry (CWS) fuel, the coal suspension includes a heavy, abrasive particulate matter. This coal particulate is prone to abrading bearing surfaces in the pump, and to settling in and clogging pump chambers and apertures.

A diaphragm pump, of the type wherein a pumping, motive fluid is sealingly separated from the pumped material by a flexible diaphragm, may be beneficially used in applications where the pumped material comprises a slurry. Such a pump, due to the separating function performed by the diaphragm, presents the advantage of mechanically isolating the particulate matter in the slurry from much of the pump mechanism. Diaphragm pumps, however, still suffer the disadvantage of internal clogging due to the settling of the particulate matter in the pump chambers and apertures.

The pumping of slurry materials at high rates and pressures poses special problems in addition to those described above. In particular, the settling qualities of the high-density particulate matter in the slurry often results in an uneven distribution of this particulate matter within a pumping chamber in the diaphragm pump. This uneven distribution of the particulate matter results in an uneven distribution of an internal, hydraulic pumping pressure on the flexible diaphragm. At high rates and pressures, this uneven distribution of the hydraulic pumping pressure causes premature wear and failure of the diaphragm.

OBJECTS OF THE INVENTION

The principal object of the present invention is to provide a new and improved diaphragm pump for pumping slurry material which is not subject to the aforementioned problems and disadvantages.

Another object of the present invention is to provide a diaphragm pump capable of reliably pumping slurry material at high rates and pressures.

A further object of the present invention is to provided a diaphragm pump wherein undesirable settling and accumulation of slurry material within the pump is inhibited.

Yet another object of the present invention is to provide a diaphragm pump wherein internal, hydraulic pumping pressures are relatively equally distributed across a flexible diaphragm.

SUMMARY OF THE INVENTION

A new and improved diaphragm pump is provided of the type wherein a flexible diaphragm mounted in a pump housing sealingly separates internally disposed pumping and driving chambers. The pumping chamber includes a circular end portion adjoining the flexible diaphragm. In accordance with one aspect of the invention, the pump housing includes an inlet aperture for conducting a pressurized slurry material into the pumping chamber in a direction tangential to the surface of the circular, pumping chamber end portion. This tangentially disposed conduction causes the slurry material in the pumping chamber to swirl, thereby inhibiting the accumulation or settling of the particulate matter in the slurry at any particular location within the chamber.

In accordance with another aspect of the invention, the diaphragm pump is constructed having a pump housing surface situated to limit the deflection of the diaphragm into the driving chamber. Further, the pump housing includes a plurality of fluid apertures for conducting a pressurized, hydraulic pumping fluid to a plurality of discrete locations within the driving chamber. This limiting of the diaphragm deflection acts separately and in combination with the conducting of the hydraulic fluid to a plurality of locations within the driving chamber, to distribute internal, hydraulic pumping pressures evenly across the diaphragm. This relatively even distribution of the internal, hydraulic pumping pressures serves to provide the diaphragm with a long, reliable operational life.

BRIEF DESCRIPTION OF THE DRAWINGS

While the specification concludes with claims defining the features of the invention that are regarded as novel, it is believed that the invention, together with further objects thereof, will be better understood from a consideration of the following description in conjunction with the drawing figures, in which like reference numerals are carried forward, and in which:

DETAILED DESCRIPTION OF THE INVENTION

Figure 1:
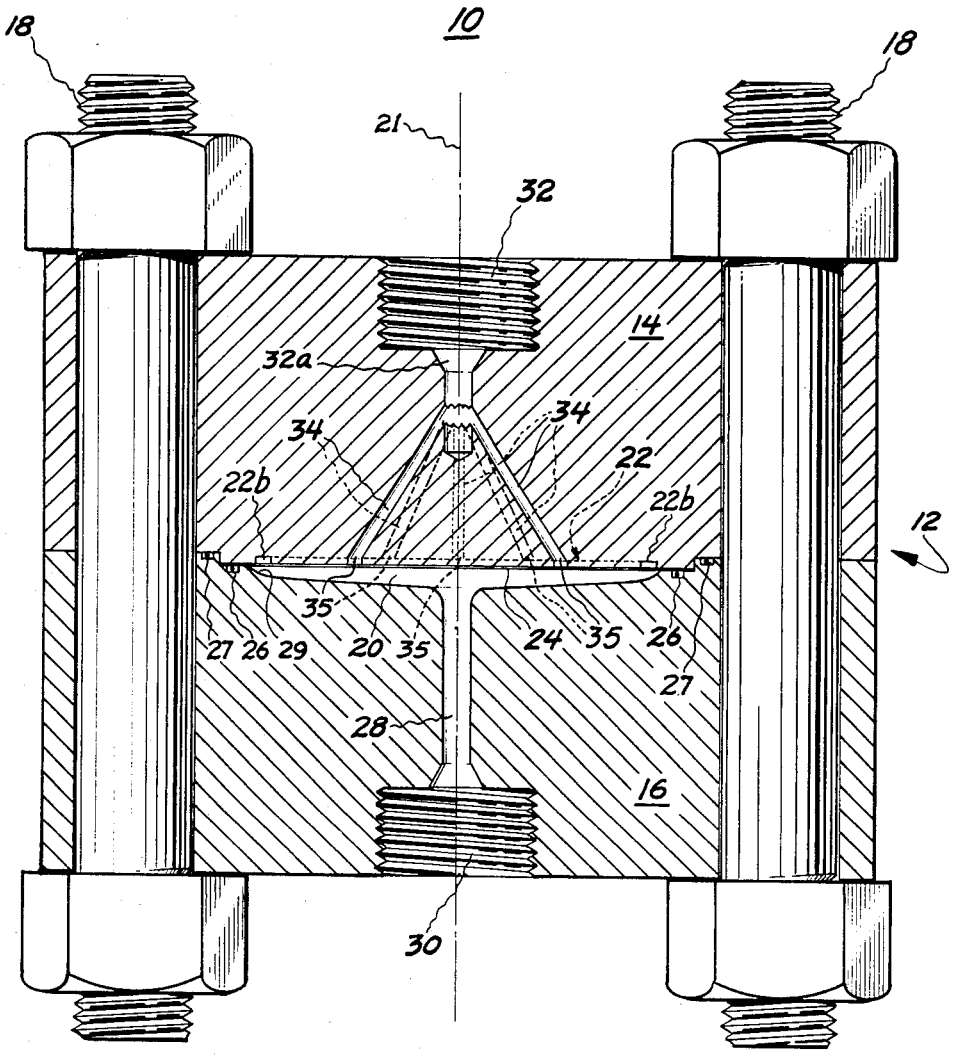
FIG. 1 is a cross-sectional top view of a diaphragm pump constructed in accordance with the present invention.

Referring now to the drawings, FIG. 1 shows a diaphragm pump 10 including a generally cylindrical, preferably stainless steel pump housing 12 comprising housing portions 14 and 16, these housing portions being clamped together by a plurality of circumferentially spaced, axially extending bolts 18. Pump housing 12 includes internally disposed pumping and driving chambers 20 and 22, respectively, each coaxially disposed with cylindrical pump housing 12 about an axis 21. A flexible diaphragm 24 comprising a titanium alloy, preferably titanium alloy 6-4 (6% aluminum, 4% vanadium and 90% titanium), is mounted in housing 12 between housing portions 14 and 16. Diaphragm 24 is sealed near its edge with an O-ring seal 26 and sealingly separates pumping chamber 20 from driving chamber 22. A second O-ring seal 27 encircles O-ring seal 26 and provides a seal between pump housing portions 14 and 16, preventing pumping fluid leakage from pump 10. Pumping chamber 20 is generally conical in shape and includes an end portion 29 adjoining diaphragm 24.

An outlet aperture 28, coaxially disposed about axis 21, communicates through housing portion 16 between a threaded outlet chamber 30 and the narrow end of conically shaped pumping chamber 20. A plurality of fluid apertures 34 communicate through housing portion 14 between a generally conical end portion 32*a* of a threaded fluid chamber 32 and driving chamber 22. Fluid chamber 32 is coaxially disposed about axis 21. Each fluid aperture 34 terminates in a respective port 35 disposed at a discrete location in driving chamber 22.

Figure 2:
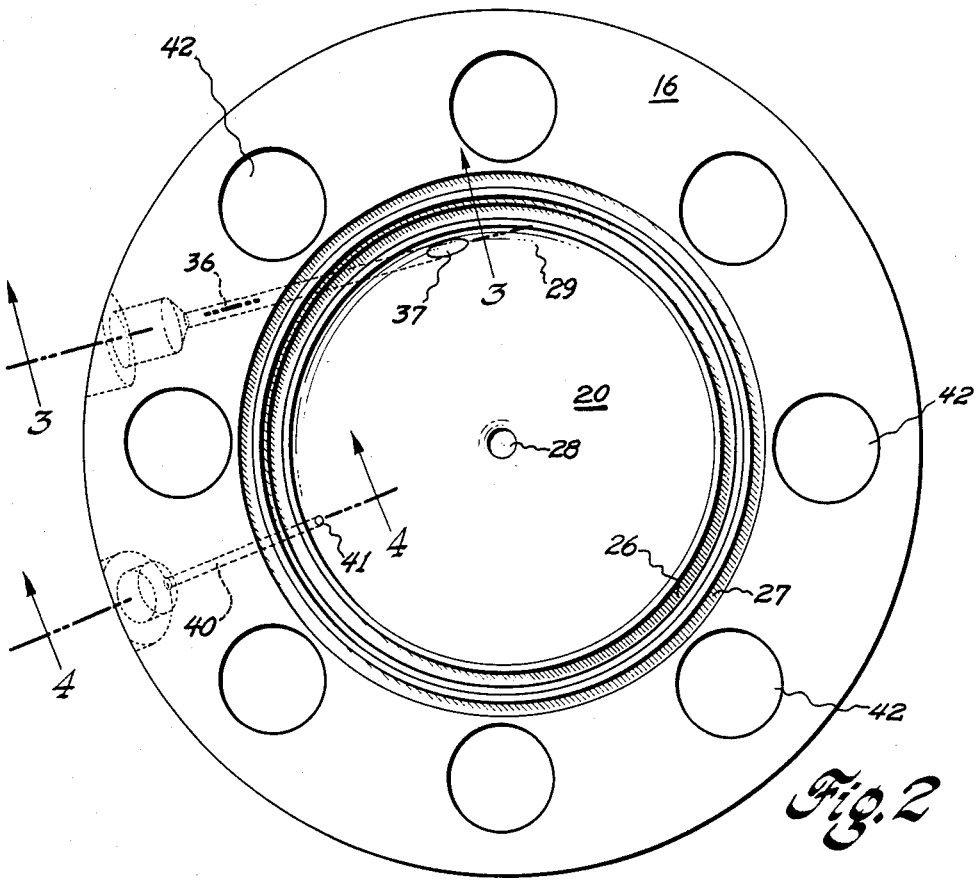
FIG. 2 is a front view of pump housing portion 16 of FIG. 1, illustrating pumping chamber 20.

Referring now to FIG. 2, end portion 29 of pumping chamber 20 is seen to have a circular cross-sectional shape. A straight inlet aperture 36, having a circular cross-sectional shape, communicates through pump housing portion 16 and terminates in a port 37 disposed on the surface of pumping chamber end portion 29. In accordance with the present invention, inlet aperture 36 is disposed tangentially to the surface of pumping chamber end portion 29. A sealable vent 40 communicates through pump housing portion 16 and terminates in a port 41 disposed on the surface of driving chamber 20. Eight bolt holes 42 are regularly spaced around the circumference of pump housing portion 16 for accommodating bolts 18.

Figure 3:
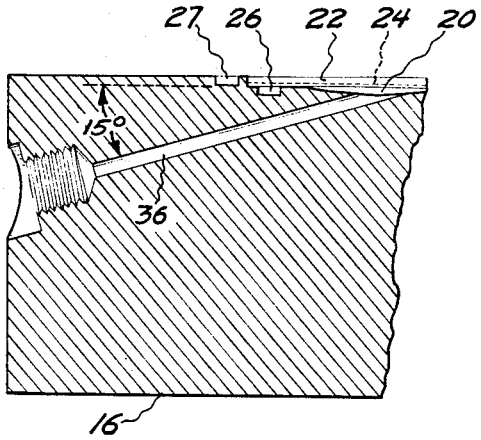
FIG. 3 is a sectional view taken along line 3—3 of FIG. 2.
Figure 4:
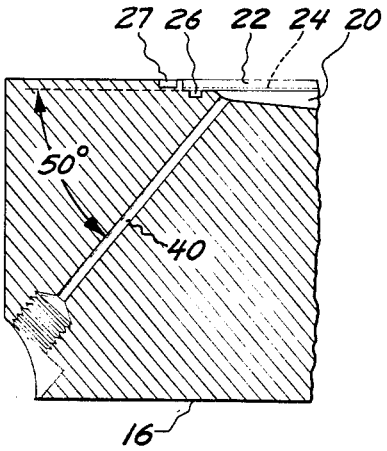
FIG. 4 is a sectional view taken along line 4—4 of FIG. 2.

As is illustrated in FIG. 3, in the preferred embodiment of the invention inlet aperture 36 is disposed at approximately a 15° angle to unflexed diaphragm 24 (shown in dashed line). As illustrated in FIG. 4, vent aperture 40 is disposed at approximately a 50° angle with respect to unflexed diaphragm 24 (shown in dashed line).

Figure 5:
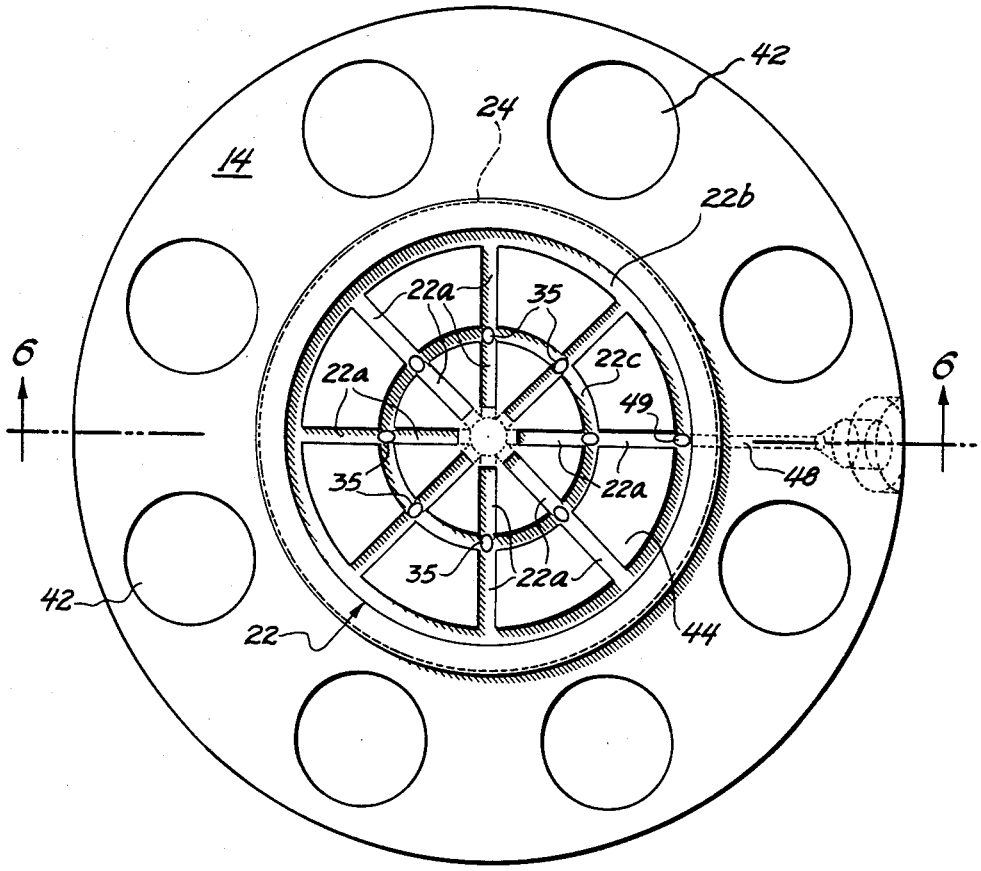
FIG. 5 is a front view of pump housing portion 14 of FIG. 1, illustrating driving chamber 22.
Figure 6:
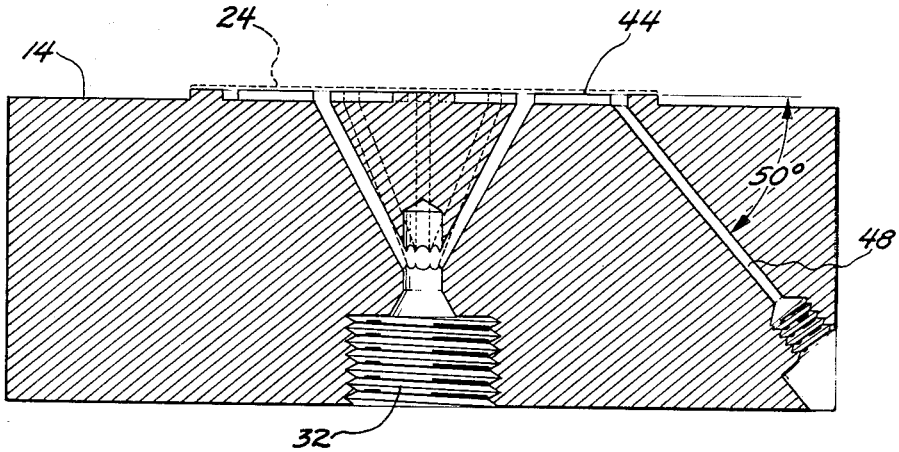
FIG. 6 is a sectional view taken along line 6—6 of FIG. 5.

As will be apparent from a consideration of FIG. 5 in light of FIG. 1, pump housing portion 14 includes a generally circular surface 44 disposed coaxially with pumping chamber 20 about axis 21 and situated normally in contact with substantially the entire surface of diaphragm 24 (the edge of which is shown in dashed line in FIG. 5) when the diaphragm is in an unflexed position. Driving chamber 22 comprises a plurality of interconnected grooves in surface 44 of housing portion 14. Specifically, eight equidistant, radially extending grooves 22*a* each originate near axis 21 of chamber 22 and terminate just short of the edge of diaphragm 24. A circularly disposed groove 22*b* connects the terminating ends of radial grooves 22*a*, while a circularly disposed groove 22*c* connects these radial grooves approximately at their midpoints. Each port 35 of a fluid aperture 34 is disposed at a respective intersection of a radial groove 22*a* and a circular groove 22. A sealable vent aperture 48 communicates through pump housing portion 14 with driving chamber 22 and includes a port 49 on the surface of the driving chamber. As illustrated in FIG. 6, in the preferred embodiment of the invention vent aperture 48 is disposed at about a 50° angle to the plane of unflexed diaphragm 24 (shown in dashed line).

The operation of diaphragm pump 10 will be described with respect to a combustion system requiring the pumping of a coal-water slurry (CWS) fuel at a high instantaneous rate, for example in the range of from 5–15 gallons per minute (GPM), and high peak pressure, for example, in the range of 5,000–15,000 pounds per square inch (psi). In such an application, CWS fuel (not shown) is conducted into pumping chamber 20 via inlet aperture 36 at a constant pressure of approximately 500 to 700 psi. In accordance with the present invention, the positioning of inlet aperture 36 directs the fuel slurry against the surface of and in a direction tangential to end portion 29 of pumping chamber 20, causing the CWS fuel to exhibit a swirling or cyclonic motion as it is conducted under pressure into the pumping chamber. This swirling motion inhibits the coal particulate in the fuel from settling out and clogging pumping chamber 20, or inlet and outlet apertures 36 and 28, respectively. Further, the swirling motion of the fuel within chamber 20 inhibits the dense coal particulate from settling and thereby blocking the motion of diaphragm 24.

In one exemplary construction of the preferred embodiment of the invention, diaphragm 24 is selected to have a diameter of approximately 4-1/16 inches, and a thickness in the range of 15–17 mils. The diameter of pumping chamber end portion 29, which bounds what is commonly referred to in the art as the working or exposed, flexing surface of diaphragm 24, is selected to be approximately 3.6 inches. Further, while inlet aperture 36 would in an ideal situation best be disposed substantially parallel to the plane of unflexed diaphragm 24, practical construction limitations dictate that the angle between the inlet aperture and diaphragm be not less than about 10°. It has been determined that angles up to 30° would provide for proper operation of pump 10. It will, of course, be appreciated by those skilled in the art that these dimensions can be varied to meet different operational requirements.

To pump the CWS fuel outward of housing 12 via outlet aperture 28 and chamber 30, a hydraulic fluid (not shown) is introduced into driving chamber 22, via fluid chamber 32 and fluid apertures 34, at a pressure of approximately 5,000 to 15,000 psi. Further in accordance with the present invention, this conducting of the hydraulic fluid into driving chamber 22 through a plurality of fluid apertures 34, each having a respective port 35 in the driving chamber, serves to provide rapid, uniform distribution of the pumping fluid pressure across the surface of the diaphragm. The formation of driving chamber 22 as the regularly spaced grooves in housing surface 44 further serves to equally distribute the pressure of the hydraulic fluid across diaphragm 24, while the placement of housing surface 44 limits the range of deflection of the diaphragm. This equal distribution of the hydraulic fluid pressure serves to increase the lifespan of the diaphragm by inhibiting its wear or puncture at any single, high-pressure point. The hydraulic fluid thus causes diaphragm 24 to deflect into pumping chamber 20, thereby forcing the CWS fuel in the pumping chamber out through outlet aperture 28 and subsequently through outlet chamber 30. When the pressure is removed from the hydraulic fluid, the CWS fuel is again conducted, under pressure supplied by an external pump (not shown), into pumping chamber 20, thereby causing diaphragm 24 to deflect back against housing surface 44. The hydraulic fluid is thus forcibly conducted out of driving chamber 22 via fluid apertures 34, and pumping chamber 20 refilled with fuel in preparation for the next pumping cycle. An external check valve (not shown), connected in series with inlet aperture 36, prevents CWS fuel from being pumped backward through the inlet aperture during the conduction of the pressurized hydraulic fluid into driving chamber 22.

Sealable vent apertures 40 and 48 operate to vent air trapped in pumping chamber 20 and driving chamber 22, respectively, during an initial cycle of the pump operation. These vent apertures are sealed after the initial pump cycle, for example with a threaded plug (not shown), and remain sealed during continued operation of the pump. If the operation of pump 10 is discontinued in a manner permitting air to enter driving chamber 22 or pumping chamber 20, the appropriate vent aperture is unsealed to vent the air during the subsequent initial pump cycle.

In summary, a new and improved diaphragm pump is disclosed wherein a slurry material is inhibited from settling in the pumping chamber. Further, the pump operates to relatively evenly distribute the pressure of a hydraulic fluid across the diaphragm. The resulting diaphragm pump is capable of pumping slurry materials at high rates and pressures while maintaining reliable operation over a long, effective lifespan.

While a preferred embodiment of the invention has been illustrated and described, it will be clear that the invention is not so limited. Numerous modifications, changes, variations, substitutions and equivalents will occur to those skilled in the art without departing from the spirit and scope of the present invention. Accordingly, it is intended that the invention herein be limited only by the scope appended claims.

What is claimed is:

1. A diaphragm pump comprising:

a pump housing including internally disposed pumping and driving chambers, at least one fluid aperture communicating with said driving chamber for conducting a pressurized fluid into and out of said driving chamber, and an inlet and outlet aperture each communicating with said pumping chamber for conducting a pressurized material into and out of said pumping chamber, respectively;

a flexible diaphragm mounted in said pump housing and sealingly separating said pumping and driving chambers;

said pumping chamber generally conical in shape including an end portion adjoining said diaphragm and having a cross-sectional area of generally circular shape; and said inlet aperture substantially straight, disposed substantially tangential to the surface of said pumping chamber end portion and including a port disposed on the surface of said pumping chamber end portion.

2. A diaphragm pump comprising:

a pump housing including internally disposed pumping and driving chambers, at least one fluid aperture communicating with said driving chamber for conducting a pressurized fluid into and out of said driving chamber, and an inlet and outlet aperture each communicating with said pumping chamber for conducting a pressurized material into and out of said pumping chamber, respectively;

a flexible diaphragm mounted in said pump housing and sealingly separating said pumping and driving chambers;

said pumping chamber including an end portion adjoining said diaphragm and having a cross-sectional area of generally circular shape;

said inlet aperture substantially straight, disposed substantially tangential to the surface of said pumping chamber end portion and including a port disposed on the surface of said pumping chamber end portion;

said diaphragm generally flat when in an unflexed position; and said inlet aperture disposed at an angle between 10° and 30° with respect to said diaphragm in said unflexed position.

3. The diaphragm pump of claim 2 wherein said diaphragm comprises a titanium alloy.

4. The diaphragm pump of claim 2 wherein:

the cross-sectional area of said pumping chamber decreases as a function of distance from said diaphragm; and said outlet aperture communicates with the narrowest portion of said pumping chamber.

5. The diaphragm pump of claim 5 wherein said pumping chamber has generally the shape of a cone.

6. The diaphragm pump of claim 2 wherein said pump housing further includes a surface disposed parallel to said diaphragm for limiting the deflection of said diaphragm into said driving chamber.

7. A diaphragm pump comprising:

a pump housing including internally disposed pumping and driving chambers, a plurality of fluid apertures communicating with said driving chamber for conducting a pressurized fluid into and out of said driving chamber, each of said fluid apertures adapted to deliver said pressurized fluid to a respective location in said driving chamber, and an inlet and outlet aperture each communicating with said pumping chamber for conducting a pressurized material into and out of said pumping chamber, respectively;

a flexible diaphragm mounted in said pump housing and sealing separating said pumping and driving chambers;

said pumping chamber including an end portion adjoining said diaphragm and having a cross-sectional area of generally circular shape;

said pump housing further including a surface disposed parallel to said diaphragm for limiting the deflection of said diaphragm into said driving chamber;

said inlet aperture substantially straight, disposed substantially tangential to the surface of said pumping chamber end portion, and including a port disposed on the surface of said pumping chamber end portion;

said pump housing surface generally circular, coaxial with said pumping chamber end portion, and disposed in contact with substantially the entire surface of said diaphragm when said diaphragm is in an unflexed position;

said driving chamber including a plurality of radially extending grooves disposed on said pump housing surface;

said fluid apertures of like plurality as said driving chamber grooves, each of said fluid apertures including a respective port disposed in a respective one of said driving chamber grooves;

said diaphragm generally flat when in an unflexed position;

said aperture disposed at an angle between 10° and 30° with respect to said diaphragm in an unflexed position;

said radially extending grooves regularly spaced;

said driving chamber further comprising a first circular groove disposed in and coaxially with said pump housing surface, said first circular groove interconnecting said radially extending grooves; and each of said fluid aperture ports situated at a respective junction between said first circular groove and one of said radially extending grooves.

8. A diaphragm pump comprising:

a pump housing including internally disposed pumping and driving chambers, a plurality of fluid apertures communicating with said driving chamber for conducting a pressurized fluid into and out of said driving chamber, and an inlet and outlet aperture each communicating with said pumping chamber for conducting a pressurized material into and out of said pumping chamber, respectively;

a flexible diaphragm mounted in said pump housing and sealingly separating said pumping and driving chambers;

said pump housing further including a generally circular, flat surface disposed parallel to said diaphragm and in contact with substantially the entire surface of said diaphragm when said diaphragm is in an unflexed position for limiting the deflection of said diaphragm into said driving chamber;

said driving chamber comprising a plurality of radially extending grooves disposed in said pump housing surface and at least a first circular groove disposed in said pump housing surface interconnecting said radially extending grooves; and each of said fluid apertures including a port situated at a junction between said circular groove and said radially extending grooves.

9. The diaphragm pump of claim 8 wherein:

said plurality of radially extending grooves are regularly spaced, each extending from a respective point of origin proximate the center of said pump housing surface to a respective point of termination proximate the circumference of said pump housing surface.

10. The diaphragm pump of claim 9 wherein:

said radially extending grooves are generally equidistant in length; and said driving chamber further includes a second circular groove disposed in said pumping chamber surface coaxially with said first circular groove, said second circular groove interconnecting the terminating ends of said radially extending radial grooves.

11. The diaphragm pump of claim 10 wherein said diaphragm comprises a titanium alloy.

12. The diaphragm pump of claim 1 wherein said diaphragm comprises a titanium alloy.

13. The diaphragm pump of claim 1 wherein said pump housing further includes a surface disposed parallel to said diaphragm for limiting the deflection of said diaphragm into said driving chamber.

* * * * *